United States Patent [19]

Goto

[11] 4,023,922

[45] May 17, 1977

[54] SMOKER'S LIGHTER

[75] Inventor: Kenjiro Goto, Saitama, Japan

[73] Assignee: Mansei Kogyo Kabushiki Kaisha, Saitama, Japan

[22] Filed: Dec. 18, 1975

[21] Appl. No.: 641,815

[30] Foreign Application Priority Data

Dec. 20, 1974 Japan ..... 49-155584

[52] U.S. Cl. ..... 431/264; 431/132; 431/256; 361/256

[51] Int. Cl.[2] ..... F23Y 2/28

[58] Field of Search ..... 431/255, 256, 254, 132, 431/264; 317/81, 95, 96

[56] References Cited

UNITED STATES PATENTS

| | | | |
|---|---|---|---|
| 3,781,163 | 12/1973 | Ovens | 431/255 |
| 3,850,570 | 11/1974 | Remy | 431/255 |
| 3,883,246 | 5/1975 | de Mere | 431/264 |

*Primary Examiner*—Edward G. Favors

*Attorney, Agent, or Firm*—Oblon, Fisher, Spivak, McClelland & Maier

[57] ABSTRACT

An electrically-ignited gas lighter with a capacitor discharge ignition circuit is provided with a blocking oscillator and an oscillation transformer to increase the level of the voltage from a single silver oxide battery of 1.5 volts to a higher level of at least 100 volts for charging the storage capacitor through a half-wave rectifier. A triggering circuit is provided to discharge the storage capacitor automatically and periodically through a silicon controlled rectifier at a predetermined voltage.

28 Claims, 11 Drawing Figures

FIG.8
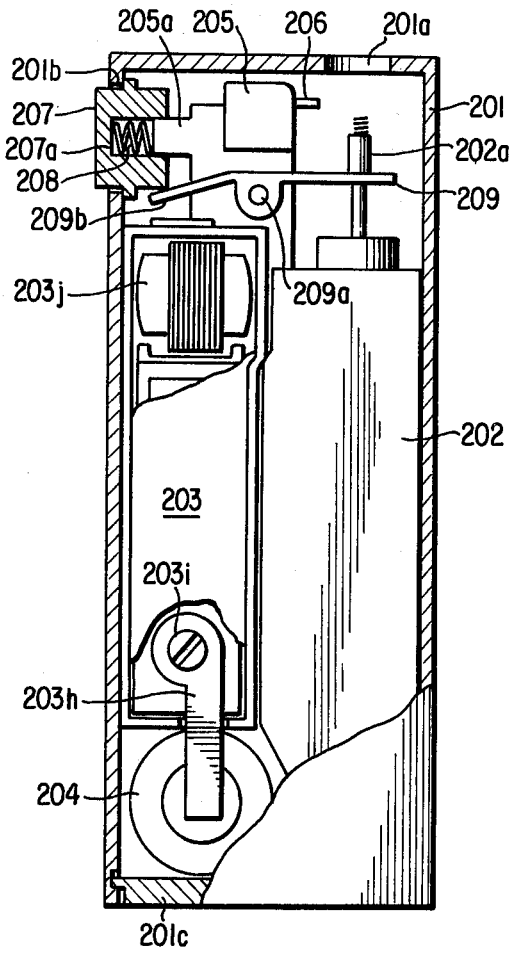
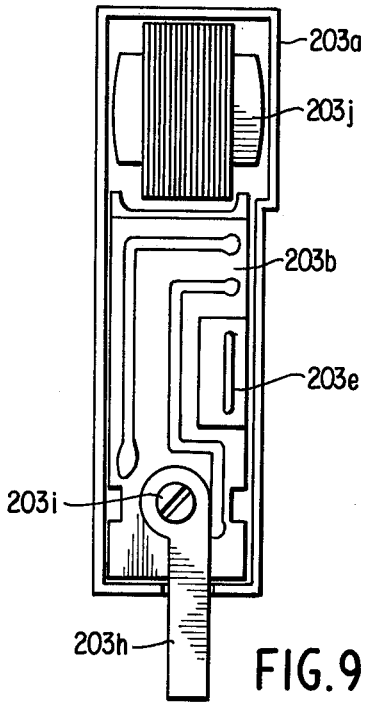
FIG.9
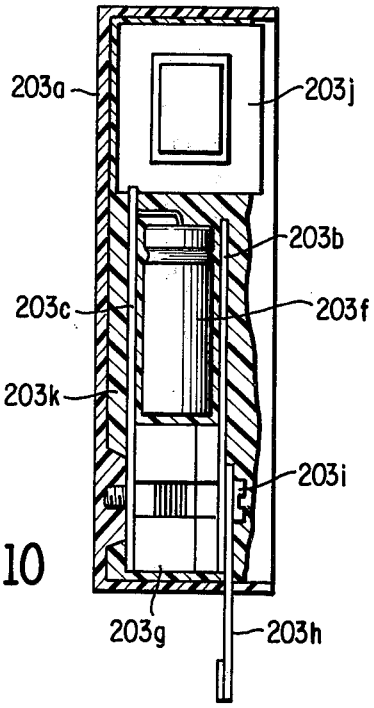
FIG.10

SMOKER'S LIGHTER

BACKGROUND OF THE INVENTION

1. Field of the Invention

This invention relates to an electrically-ignited smoker's lighter wherein a capacitor discharges automatically and periodically to ignite a fuel.

2. Description of the Prior Art

An electrically-ignited smoker's lighter is disclosed in U.S. Pat. No. 3,779,692. In this patent, a transistorized multivibrator is used to increase the level of voltage from an internal battery to a higher level for charging the capacitor. Since the output of such a multivibrator is symmetrical to the zero level of the output, a full-wave rectifier is used to charge the capacitor. The level of a recified voltage is several tens of volts so that a storage capacitor of large capacity and a step-up transformer having a large turns ratio and a large iron core cross section must be used to sufficiently increase the level of voltage for igniting a fuel gas. Further, in this ignition circuit, there is a recharge-controlling semiconductor switch constituted by two transistors, two capacitors and three resistors in order to prevent recharging of the storage capacitor for further spark production until a further actuation of the manually operable switch is performed.

Further, German laid open specification No. 1,629,907 discloses a similar ignition circuit. In this patent, a relatively large-sized luminous discharge valve is used to discharge the storage capacitor. However, such discharge valve is shortlived and its firing potential is unstable and changeable.

SUMMARY OF THE INVENTION

An object of this invention is therefore to provide a smoker's lighter which may discharge a multiple of sparks automatically and periodically in a single operation.

Another object of the invention is to provide a smoker's lighter which is simple in construction andstable in operation.

A further object of the invention is to provide a smoker's lighter which operates effectively and assuredly from a low voltage battery of 1.5 volts.

The foregoing and other objects are attained in accordance with one aspect of the present invention through provison of an electrically-ignited gas lighter comprising a casing, a fuel tank having a gas injecting valve and a gas spouting valve with a burner nozzle, an ignition circuit unit including a circuit case accomodating an ignition circuit therein, the ignition circuit comprising a blocking oscillator having an output terminal and a terminal for connecting a battery through a switch, a half-wave rectifier connected to the output terminal for rectifying the output of the blocking oscillator to charge a storage capacitor, a discharge circuit constituted by a storage capacitor, a step-up transformer, a semiconductor switching device having a gate, the step-up transformer having an output winding for connecting an ignition electrode to ignite a fuel gas from the burner nozzle, and a triggering circuit connected to the gate of the semi-conductor switching device to trigger automatically and periodically the same by means of the charged voltage of the capacitor.

In the ignition circuit, in accordance with the invention, a semi-fixed variable resistor is connected to the feedback winding of the oscillation transformer of the blocking oscillator for adjusting the base bias current to adjust a value of current flow from the battery to a collector-emitter path through the primary winding of the oscillation transformer to thereby adjust the charging speed of the storage capacitor. It is essential to adjust the base bias current of the transistor in the oscillaor in the manufacture of the circuit since the current amplification factors (hfe) of the transistors are not constant and therefore the operation of the circuit fluctuates. The adjustment ensures an optimum period of continuous sparks and therefore the life of the battery.

In an experiment, from a single battery, 45,000 times of sparks have been obtained on the average with the use of a conventional silver oxide battery. In other words, the battery bears a use of three years with the optimum period of sparks. The output of the blocking oscillator appears in the output winding and mostly in the positive side of the zero level so that by means of a single rectifier most of the output can be rectified to charge the storage capacitor.

A feature of the circuit according to the invention is that a DC-DC convertor is constituted by a few components. They are one transistor, one oscillation transformer having primary, feedback and output windings, one rectifier (halfwave rectifier) and one semi-fixed variable resistor.

It is the number and sizes of the electric parts, especially the sizes of the step-up transformer and storage capacitor, that fix the cost and the size of the circuit in the lighter. In order to make the discharge circuit small with a reliable operation, the capacitor must be of a relatively small capacity and a large charged voltage and the step-up transformer must be of a small turns ratio and have a small iron core cross section. In the experiment, the capacity and the charged voltage of the storage capacitor were 1.5 to 2.5 microfarad and 100 to 115 volts respectively. The effective cross section of the iron core and the turns ratio of the step-up transformer were 3.5mm X 1.25 mm and 80 to 90T: 5400 to 5600T respectively.

A further feature of the circuit according to this invention is that the discharge circuit comprises the storage capacitor having a relatively small capacity and a charged voltage of at least 100 volts, a relatively small step-up transformer having at least a 1/60 turns ratio and a semi-conductor switching device having a gate such as thyristor. Among the various kinds of thyristors, a SCR (silicon controlled rectifier) is preferable in the ignition circuit of the invention. According to the invention, a trigger element breaks down with the charged voltage of the storage capacitor and the SCR is triggered on. The SCR can be turned on with a relatively small gate current so that its switching operation is stable and reliable.

In order to automatically and periodically discharge through the SCR the storage capacitor which is charged with relatively high voltage, the triggering circuit connected to the gate of the SCR must constantly switch on the SCR with a relatively high voltage. However, the break down voltage of a conventional trigger diode usually is less than 40 volts. Our experiments have shown that a trigger circuit constituted by a SBS (Registered Trade Mark, silicon bilateral switch), a zener diode and a resistor or by three diacs, a zener diode and a resistor provides the best results.

A further feature of the circuit according to the invention is that the triggering circuit of the SCR automatically and periodically switches on the SCR with the relatively high charged voltage of the storage capacitor.

Again referring to U.S. Pat. No. 3,779,692, the electric parts are disposed in an epoxy resin and in the shape of of a rectangular box. It is preferable that the assembly of the circuit be easily performed and the circuit be made as a small-sized ignition circuit unit.

In view of the facility of assembly, it is perferable to accommodate in the circuit case a Bakelite (Registered Trade Mark) plate on which the parts are soldered beforehand and to then pour a potting material into the circuit case to fix and insulate the circuit rather than to dispose the parts in an epoxy resin to be potted. Further, a silicon resin rather than an epoxy resin is used for a potting material because of wet-proof characteristic.

A further feature according to this invention is that the circuit unit comprises a circuit case, a circuit plate of Bakelite accomodated in the case, a step-up transformer arranged in the case, parts soldered on the bakelite plate, and silicon resin poured into the case to fix and insulate the circuit.

A further feature according to the invention is that the transistor of the blocking oscillator, the half-wave rectifier, the SCR of the discharge circuit, and the triggering circuit are made in integrated circuit in order to make small the size of the ignition circuit.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 8 shows a part sectional view illustrating the internal arrangement of components of the lighter of a second embodiment.

FIG. 9 shows the circuit unit in which the electric parts are sandwiched between two Bakelite circuit plates.

FIG. 10 shows a sectional view of the circuit unit of FIG. 9 but with the electric parts potted in silicon resin.

DETAILED DESCRIPTION OF THE PREFERRED EMBODIMENTS

Figure 1:
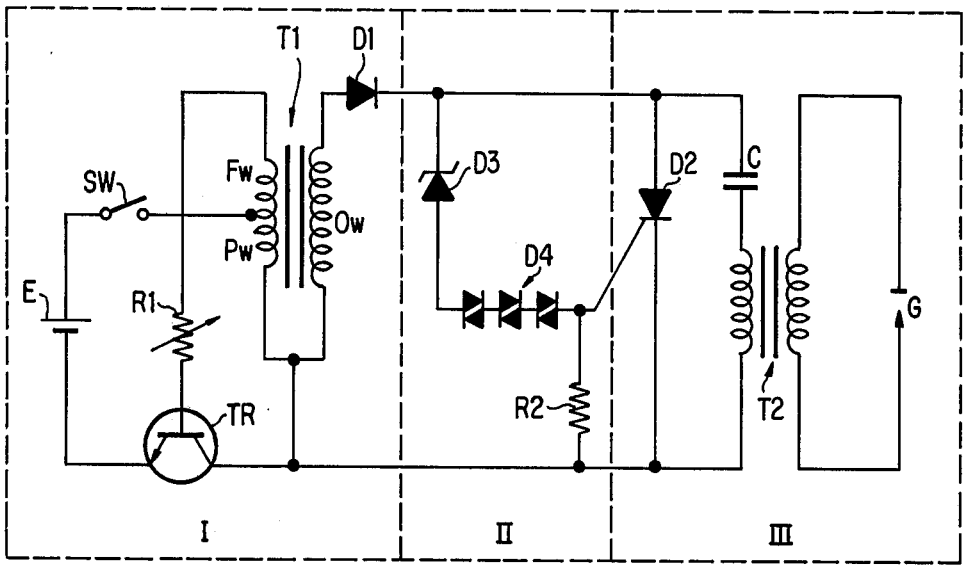
FIG. 1 shows a circuit diagram of an automatic and periodic capacitor discharging ignition circuit in accordance with the invention.
Figure 2:
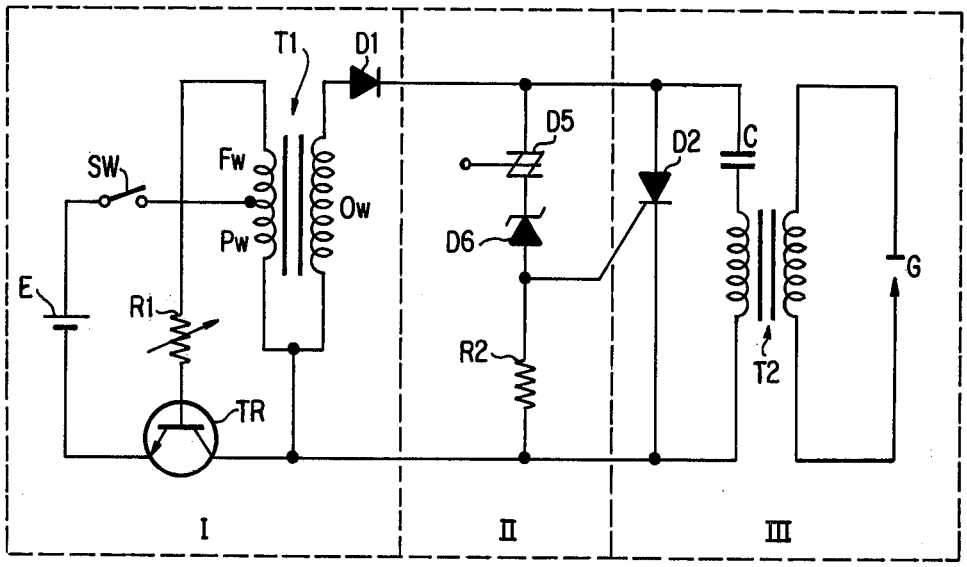
FIG. 2 shows a modified circuit diagram of FIG. 1 in which the triggering circuit is different from that of FIG. 1.

Referring now to the drawings, wherein like reference numerals designate identical or corresponding parts throughout the several views, and more particularly to FIGS. 1 and 2 thereof, there is shown an ignition circuit for use in a smoker's lighter. The ignition circuit generally comprises a battery E, a switch SW, a DC-DC convertor I, a discharge circuit III and a triggering circuit II for SCR D2 of the discharge circuit.

The DC-DC convertor I is connected to the switch SW and the negative pole of the battery E. This DC-DC convertor consists of a transistor Tr, a semi-fixed variable resistor R1, an oscillation transformer T1 and a half-wave rectifier D1. The base of the transistor Tr is connected to the positive pole of the battery E through the semi-fixed variable resistor R1, a feedback winding Fw of the oscillation transformer T1 and the switch SW. The emitter of the transistor Tr is connected to the negative pole of the battery E. The collector is connected to the positive pole of the battery E through a primary winding Pw of the oscillation transformer T1. The transistor Tr, semifixed variable resistor R1 and the oscillation transformer T1 constitute a blocking oscillator. The half-wave recitifer D1 is connected to an output winding Ow of the oscillation transformer T1 and the positive terminal of the storage capacitor C (described later).

The discharge circuit III is connected to the DC-DC convertor I and consists of the storage C, a step-up transformer T2, a SCR D2 and spark gap G. The storage capacitor C is connected at its negative terminal to the output terminal Ow of the oscillation transformer T1 via the primary winding of the step-up transformer T2. The secondary winding of the step-up transformer T2 is connected to the spark gap G. The SCR D2 is connected at its anode side to the positive terminal of the storage capacitor C and at its cathode side to the primary winding of the step-up transformer T2.

The triggering circuit II is connected to the gate electrode of the SCR D2 and the positive terminal of the storage capacitor C to trigger the SCRD2. In FIG. 1, this triggering circuit consists of a zener diode D3, three diacs D4 in series connection and resistor R2. The cathode of the zener diode D3 is connected to the positive terminal of the capacitor C and the anode is connected to the junction of the gate of the SCR D2 and a resistor R2 through the three diacs. In FIG. 2, the triggering circuit consists of a SBS D5 with gate open, a zener diode D6 in series connection and a resistor R2. The terminal of the SBS D5 is connected to the positive terminal of the storage capacitor C and the anode of the zener diode D6 is connected to the gate of the SCR D2.

Ignition of a butane gas requires various delicate conditions with respect to the voltage and energy of sparks at the spark gap. Of course the arrangement and construction of the spark gap affect those conditions. However, in the light of the general conditions of a smoker's lighter, the voltage generated is preferably 7500 volts or more. It must not be less than 6500 volts.

According to the present invention, such voltage is obtained from a single silver oxide of 1.5 volts. The turns ratio of the step-up transformer T2 is 1:60 to 1:70. Transformer T2 has a primary winding of 80 to 90 turns and a secondary winding of 5400 to 5600 turns. The thickness of the wire of each winding is 0.12 mm and 0.02 mm in diameter, respectively. The storage capacitor C is of 1.5 to 2.5 micro farad capacity and the energy stored in this storage capacitor C is at least 8 mJ to effect satisfactory ignition. The voltage applied to this capacitor C depends upon and may be determined by the SCR D2 and its triggering circuit and this is designed to be applied with a voltage 100 to 115 volts when the capacitor C is charged. Thus, capacitor bulk is avoided.

As a trigger element for the SCR D2, the diac is used in series connection. This element is useful because it shows preferable characteristics under changing temperatures. However, the withstand voltage of a single diac is normally around 30 volts. Therefore, in view of the voltage applied, three diacs are connected in series together with the zener diode. Further, this series connection of three diacs is preferable as well in view of the integrated circuit of the unit which will be described hereinafter. Namely, there are variations in the characteristics of the diacs produced in such a way. However, as these diacs are used in combination, such variations may be compensated. In FIG. 2, the SBS D5 is used in connection with the zener diode D6. This SBS D5 is a negative resistance device and it is advantageous to switch the SCR D2 on quickly. The withstand voltage of the SBS D5 is, however, less than 10 volts and the zener diode D6 is connected to withstand the voltage of 100 to 115 which is applied to the terminals.

With respect to the oscillation transformer T1, the turns of the coil of the primary and feedback windings Pw and Fw are selected between 40 and 50 turns. The thickness of the coil is 0.1 mm for the primary winding and 0.04 mm for the feedback winding. To the contrary, the output winding is of 360 to 460 turns and the thickness of the coil is 0.04 mm in diameter. Accordingly, the turns ratio of the primary winding Pw to the output winding is about 1/10.

The semi-fixed variable resistor R1 is arranged in connection with the base electrode of the transistor Tr. This is adapted to control the emitter-collector current of the transistor Tr and the charging speed of the capacitor C. The time interval of the sparks may be voluntarily determined by changing the value of this resistor R1. The transistor Tr employed herein is a switching transistor which is used within the range of 0 to 20 KHz and its "hfe" fluctuates between 100 and 300. Therefore, this resistor R1 is normally set within the range of 2 to 8 K Ohms.

This ignition circuit is designed to produce sparks automatically at a predetermined time interval. Therefore, as far as the switch is closed, the lighter continues to produce sparks at the spark gap even after the fuel is ignited. Once ignited, no subsequent sparks are necessary to be produced. Therefore, such time intervals should be enough for user to turn the switch "off" before the subsequent spark is produced. In view of this, it should preferably be not faster than a half second but not greater than a second. For this purpose, the semi-fixed variable resistor is set within the range of 2 to 8 K Ohms.

The resistor R2 is connected between the gate and cathode electrodes of the SCR D2 to prevent the gate from overcurrent. Further, the resistor R2 is used to reversely bias the gate to turn the SCR D2 off after the storage capacitor C is discharged. It is preferable in this case that the value of resistance of the resistor R2 be 100 Ohm ± 30%.

In the operation of this ignition circuit, the blocking oscillator in response to the operation of a switch SW will feed pulses to the primary winding of the oscillation transformer T1 and these pulses will be stepped up by an output winding. The output pulses appear mostly in the positive side of the zero level of the output so that these are charged into the storage capacitor C through the half-wave rectifier D1.

When the charge voltage of the storage capacitor C reaches a predetermined level (100 to 115 volts), which depends on the trigger elements, the trigger elements break down and a positive voltage drop across the resistor R2 is applied between the gate and cathode of SCR D2 having its anode-cathode path in series with the primary winding of the step-up transformer T2 and the storage capacitor C.

Firing of the SCR D2 permits the built-up charge on the capacitor C to discharge suddenly through the primary winding of the step-up transformer T2 and the anode-cathode path. This induces a very high voltage of short duration in the secondary winding. A spark discharge therefore is produced across the gap G in the secondary winding of the step-up transformer T2. The sparking will continue automatically and periodically until the switch Sw is opened as the capacitor C charges relatively slowly and is discharged suddenly.

The semi-fixed variable resistor R1 is connected between the base of the transistor Tr and the terminal of the feedback winding Fw for adjusting the base bias current to adjust the value of current flow from the battery to a collector-emitter path through the primary winding Pw of the oscillation transformer T1 to thereby adjust the charging speed of the storage capacitor C.

Figure 3:
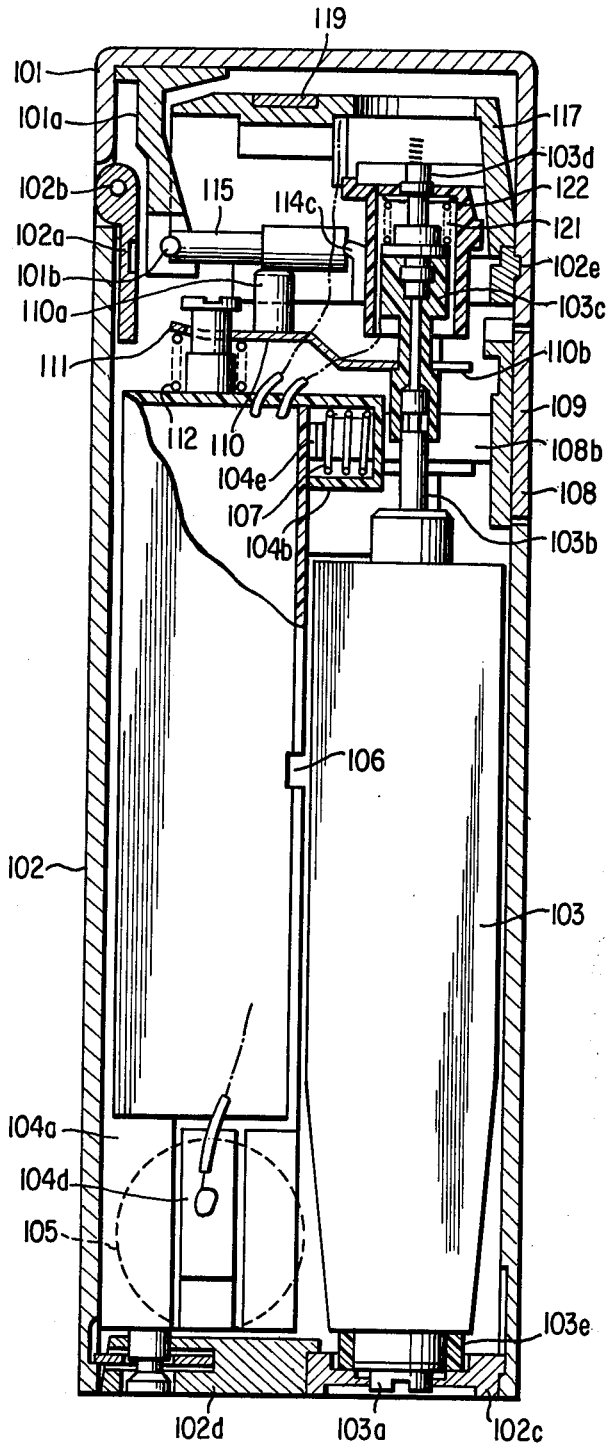
FIG. 3 shows a part sectional view illustrating the internal arrangement of parts of the lighter of a first embodiment of the invention with certain parts omitted for clarity.
Figure 4:
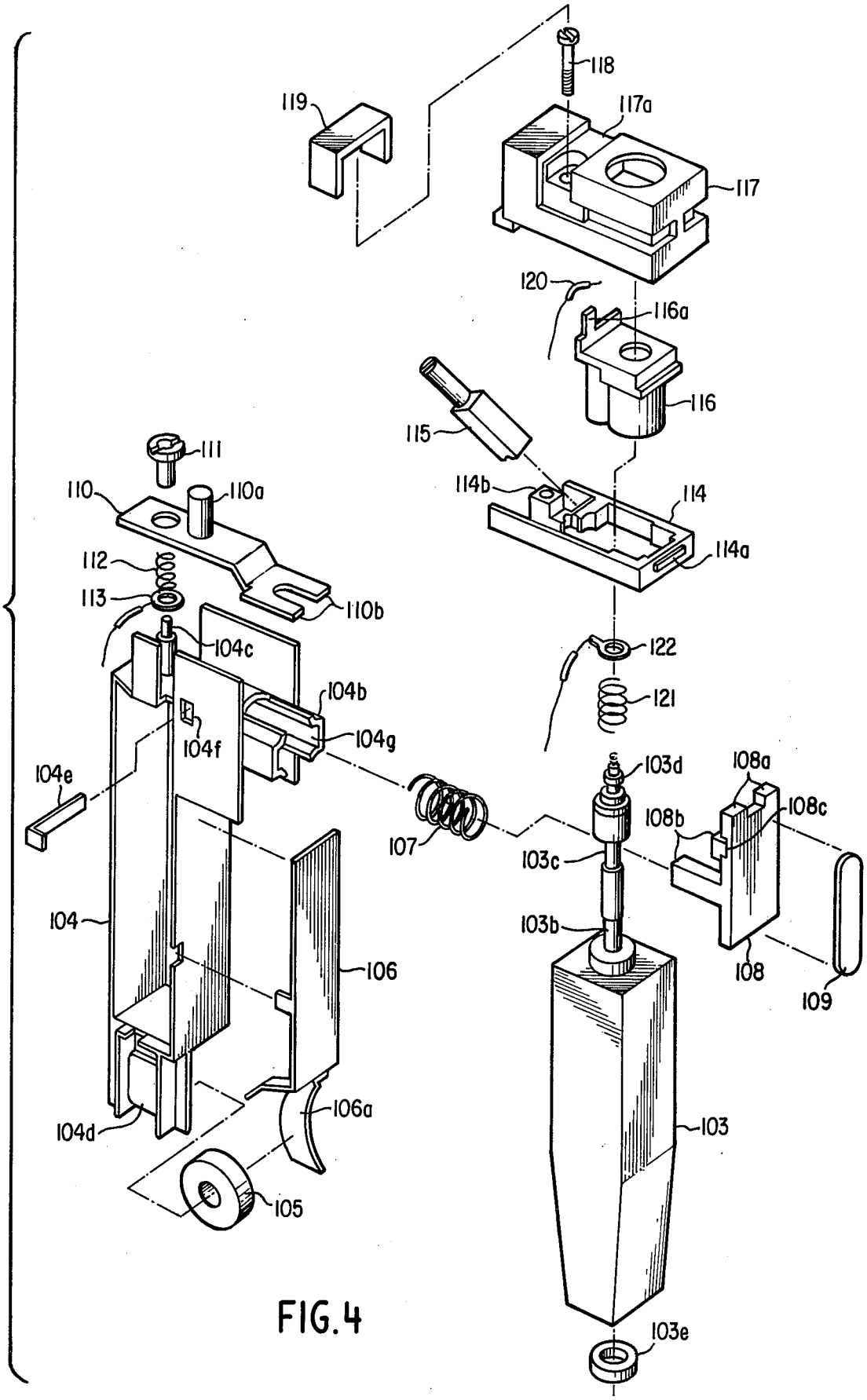
FIG. 4 shows an exploded view of the lighter of FIG. 3 with the electric parts omitted.

FIG. 3 shows the lighter of a first embodiment incorporating the ignition circuit shown in FIGS. 1 or 2. In FIGS. 3 and 4, a cap 101 is pivotably mounted on a pivot axle **102*b* of a pivot support 102*a* secured on a casing 102. Further, the cap 101 has a leg 101*a* which has a pin 101*b* which is engaged by one end of a telescopic cylinder 115. The telescopic cylinder 115 incorporates a coil spring therein (not shown), the other end of which engages a engaging portion 114*c* of a mount 114 to promote the open and close movements of the cap 101. The mount 114 includes a flange 114*a* to engage with a groove 102*e* of the casing 102 and a burner support 116 of insulating material and windshield 117 are mounted thereon. The windshield 117 is secured to the mount 114 by the engagement between a nut portion 114*b* of the mount 114 and a fixing screw 118. An ornamental member 119 engages a groove 117*a* of the windshield 117 to cover the head of the fixing screw 118**.

The burner support 116 us arranged in the windshield 117 and includes a washer 122 and a contact spring 121 therein to maintain the electric contact between the washer 122 and a burner nozzle **103*d*. An electrode 120 is fixed between a projection 116*a* of the burner support 116 and the windshield 117 and is connected to the low voltage terminal of the secondary winding of the step-up transformer T2 in FIGS. 1 or 2. The washer 122** is connected to the high voltage terminal through a lead wire so as to attain the electrical conduction between the burner nozzle and the high voltage terminal.

The burner nozzle **103*d* is insulated electrically from a fuel tank 103 through an insulator tube 103*c*. A circuit case 104 made of insulator material is integrally formed with a projection 104*c* and a switch guide 104*b* at its upper portion. A valve actuator 110, an actuating spring 112 and a washer 113 are mounted in turn on the projection 104*c* and are fixed by a screw 111 whose inside is threaded to engage the projection 104*c*. The valve actuator 110 has a protrusion 110*a* of insulator material mounted thereon and contact arms 110*b*. The protrusion 110***a* touches the side wall of the telescopic cylinder 115 to urge downwardly a valve stem 103*b* through the insulator tube 103*c* disposed between the contact arms 110*b* to close a spouting valve (not shown) against a valve spring within the valve and the actuating spring 112 when the cap 101 is closed.

The top ends of the contact arms 110*b* are electrically connected through the screw 111, the washer 113 and lead wire to the junction of the primary and feedback windings of the oscillation transformer. The top ends form a contact point which serves as a switch with a contact portion 108*a* of a switch actuator 108 (described later). The switch guide 104*b* has a guide portion 104*g* to receive a switch return spring 107 and arms 108*b* of a switch actuator 108 and has an opening 104*f* into which a contact piece 104*e* is inserted. The switch actuator 108 is made of metal and is electrically connected to a battery 105 via the arms 108*b*, the switch return spring 107, the contact piece 104*e* and the casing, in turn. The contact portions 108*a* of the switch actuator 108 serve as the other contact point of the switch and are ready for contact to the contact arms 110*b* upon actuation of the switch when cap 101 is opened. When the cap is closed, the valve actuator 110 is depressed by the telescopic cylinder 115 so that the top ends of the contact arms 110*b* may be moved from a position facing the contact portions 108*a* to a position facing the recess 108*c*. This recess 108*c* is formed on the switch actuator 108 and is located downward of the contact portions 108*a*. The depth of recess 108*c* and the lenth of the arms 108*b* of the switch actuator 108 are so designed that the switch actuator 108 can not contact the valve actuator 110 when actuated in the position when the cap is closed. On the actuation face of the switch actuator 108 is disposed an ornamental plate 109 whose outside surface is flush with the casing 102.

In the lower portion of the circuit case 104, a terminal support 104*a* is integrally formed on which a terminal plate 104*d* is disposed to contact the negative pole of the battery 105. The positive pole of the battery contacts and urging spring 106*a* integrally formed with a battery support plate 106 which is located between the circuit case 104 and a fuel tank 103 so that the positive pole is grounded to the casing 102 through the fuel tank 103. The bottom opening of the casing 102 is closed with a bottom wall 102*c* having a battery lid 102*d* to take the battery 105 out and a resilient member 103*e* is arranged between the bottom wall and the fuel tank 103 so as to urge upwardly the fuel tank 103 to fix the same in the casing 102.

In the operation of the lighter of the first embodiment, when the cap 101 is opened, the valve actuator 110 is lifted by the actuating spring 112 so that the top ends of the contact arms 110*b* may move upwardly to face the contact portion 108*a* of the switch actuator 108. At the same time, the valve stem 103*b* is also lifted by the valve actuating spring within the spouting valve to open the valve to spout the gas fuel from the burner nozzle 103*d*. The actuation of the switch actuator 108 makes the connection between the battery 105 and the ignition circuit as shown in FIGS. 1 or 2 and, therefore, the ignition sparks are produced periodically between the burner 103*d* and the spark electrode 120 when the switch is closed.

Figures 5, 11:
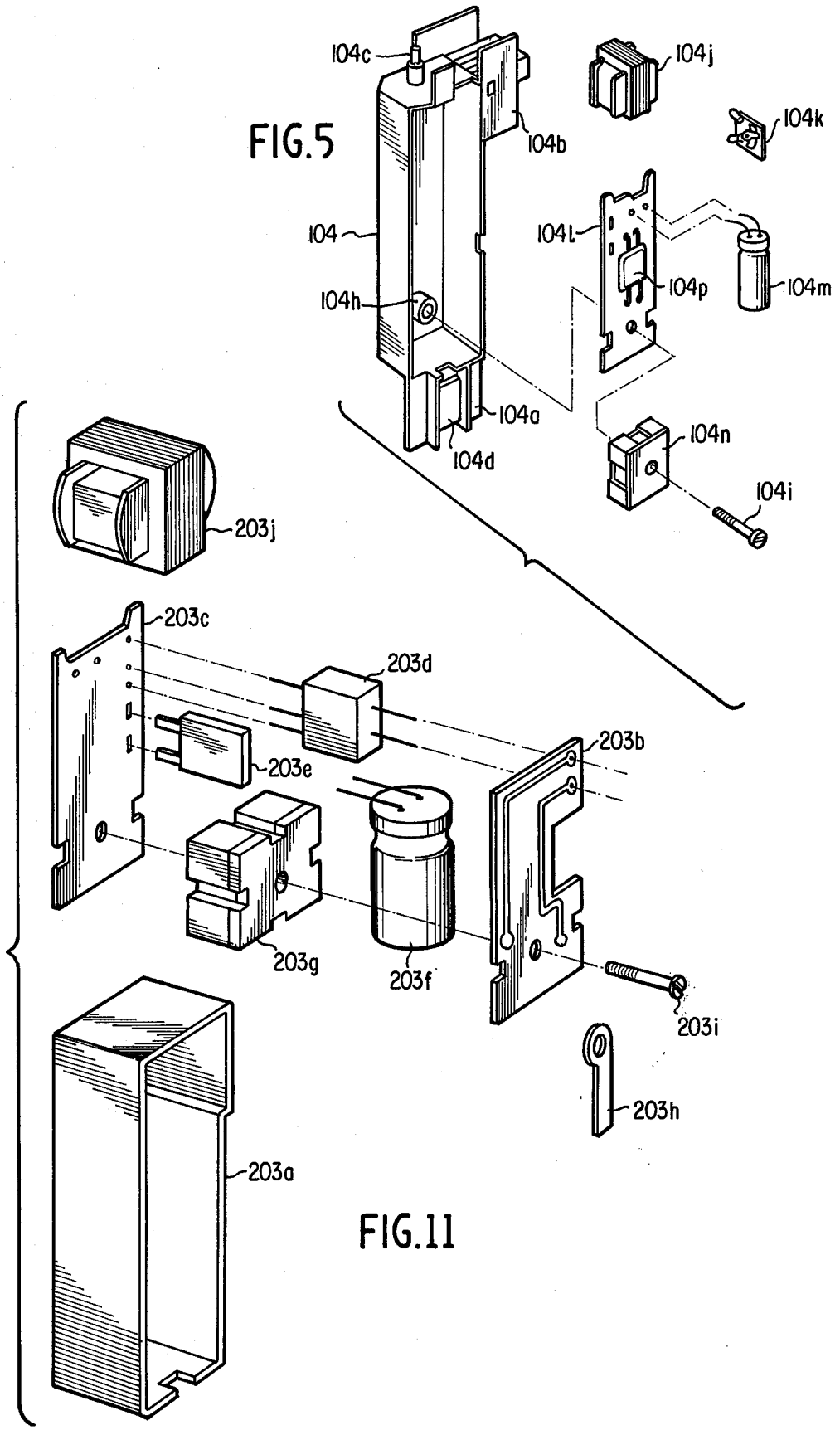
FIG. 5 shows an exploded view of the ignition circuit unit of the lighter of the first embodiment.
FIG. 11 shows an exploded view of the circuit unit of the lighter of a second embodiment.
Figure 6:
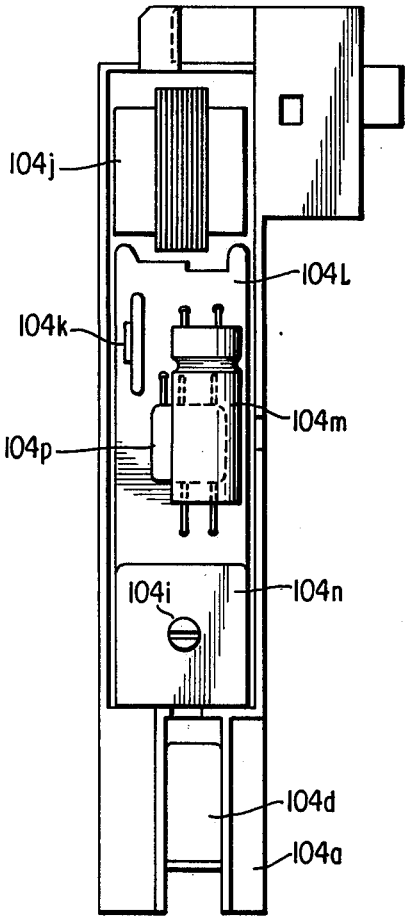
FIG. 6 shows the arrangement of the parts accomodated in the circuit case.
Figure 7:
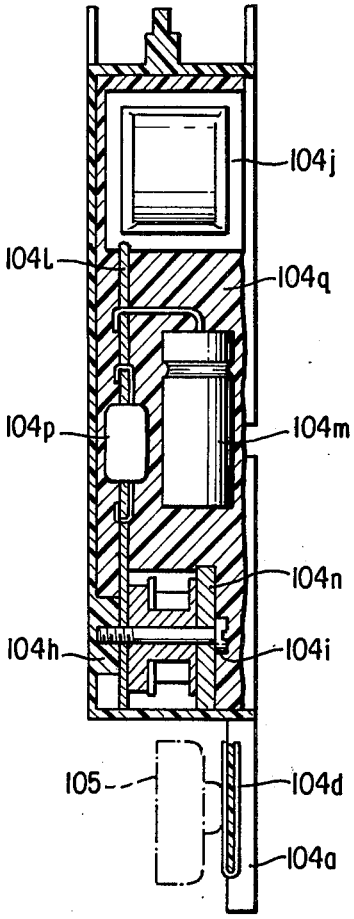
FIG. 7 shows a sectional view of the circuit unit with the parts potted in silicon resin.

Referring to FIGS. 5 to 7, there is shown the ignition circuit unit comprising the circuit case 104; a step-up transformer 104*j* arranged in the upper portion of the circuit case 104; a Bakelite plate 104*l* arranged in the circuit case; a semi-fixed variable resistor 104*k*, a storage capacitor 104*m*, an integrated circuit unit 104*p*, which are soldered on the Bakelite plate 104*l* respectively; and an oscillation transformer 104*n* fixed by a fixing screw 104*i* on the Bakelite plate 104*l* by a fixing screw which is in threaded engagement with the nut portion 104*h* of the circuit case 104.

Again referring to FIGS. 1 and 2, the integrated circuit unit 104*p* is constituted by the transistor Tr; the halfwave rectifier D1; the SCR D2; the zener diode D3; and the three diacs D4 and the resistor R2 in case of the ignition circuit of FIG. 1 or the SBS D5, the zener diode D6 and resistor R2 in case of the ignition circuit of FIG. 2. The integrated circuit unit has five terminal legs which are respectively constituted by the emitter electrode; the base electrode; the junction of the collecter electrode, the cathode of the SCR and the terminal of the resistor R2; the anode electrode of the half-wave rectifier D1; and the junction of the cathode electrode of the half-wave rectifier D1, the cathode electrode of the zener diode D3 (in FIG. 1) or the terminal of the SBS (in FIG. 2), and the anode electrode of the SCR D2. The integrated circuit unit functions to make the ignition circuit small, to decrease the cost of the ignition and to facilitate the assembly of the ignition circuit unit. On the reverse side of the Bakelite plate 104*l*, a circuit is printed so that parts are easily soldered thereon. By screwing the fixing screw 104*i*, the oscillation transformer 104*n* is fixedly secured to the Bakelite plate 104*l*. This may prevent the noise due to the relaxation oscillation of the pot-shaped core of the oscillation transformer. After the arrangement of the circuit, a silicon 104*q* is poured into the circuit case so as to fix the electric parts in the circuit case 104 and to attain electric insulation. This arrangement and construction improve the durability against sudden shock from the outside. Furthermore, the insulation of the electric parts are greatly enhanced as compared with conventional construction.

FIG. 8 shows the lighter of the second embodiment. A casing 201 is provided with a flame opening 201*a*, a guide opening 201*b* and a bottom plate 201*c*. An actuating button 207 projects from the guide opening 201*b* and is urged outwardly by a tension spring 208. This tension spring 208 is arranged within a recess 207*a* of the actuating button 207 in engagement with guide projection 205*a* of an electrode support 205. The electrode support 205 carries an electrode 206 and further rotatably carries a valve actuator 209 rotatable via a pivot pin 209*a*. The valve actuator 209 grips a burner nozzle 202*a* mounted on a fuel tank 202 at one end and engages the actuating button 207 on its slant portion 209*b* at the other end.

203 designates an ignition circuit unit which is disposed in parallel with the fuel tank 202 in the casing 201. A battery 204 is arranged under the circuit unit 203 and has a negative pole which contacts a terminal plate 203*h* of the circuit unit 203 and a positive pole which is grounded to the casing 201.

The operation of the lighter of the second embodiment is as follows. When the actuating button 207 is pushed along with the guide projection 205*a* of the electrode support 205, the actuating button 207 depresses the slant portion 209*b* of the valve actuator 209 so as to lift the burner nozzle 202*a* at the opposite side to open a gas spouting valve (not shown). At the same time, a switch (not shown) is actuated to energize the ignition circuit so as to attain the spark ignition of the lighter.

Referring to FIGS. 9 to 11, there is shown in detail the circuit 203 shown in FIG. 8. A circuit case 203*a* houses a step-up transformer 203*j*. The remainder of the electric parts are disposed sandwiched between first and second circuit plates 203*b*, 203*c* made of Bakelite. In the circuit case 203, a silicon resin is filled to fix the electric parts and to provide electric insulation. In FIG. 11, the second circuit plate 203*c* has a reverse side on which a circuit is printed and on which the three terminal legs of an integrated circuit unit 203*d*, the terminals of semi-fixed variable resistor 203*e* and the terminals of a storage capacitor 203*f* are soldered. The integrated circuit unit 203*d* is the same as the one mentioned hereinbefore.

The first circuit plate 203*b* has a printed circuit on which the two terminal legs of the integrated circuit unit 203*d* are soldered. An oscillation transformer 203*g* is disposed between the two circuit plates 203*b*, 203*c* and is fixed through a screw 203*i* which is screwed into the circuit 203*a*. Further, the screw 203*i* fixes a terminal plate 203*h* to the first circuit plate 203*b*. The terminal plate 203*h* contacts the negative pole of the battery 204 and makes the connection between the battery 204 and the integrated circuit unit 203*d*. A feature of this ingition circuit is that its size is smaller than that of the circuit unit of the first embodiment.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. An electrically-ignited gas lighter comprising:

a casing, a fuel tank mounted in the casing and having a gas injecting valve and a gas spouting valve with a burner nozzle, an ignition circuit unit comprising a circuit case accommodating an ignition circuit therein, the ignition circuit comprising a blocking oscillator having an output terminal and a terminal for connecting a battery through a switch, a half-wave rectifier connected to the output terminal and for rectifying the output of the blocking oscillator to charge a storage capacitor, a discharge circuit comprising the storage capacitor, a step-up transformer, and a semi-conductor switching device having a gate;

the step-up transformer having an output winding for connecting an ignition electrode to ignite a fuel gas from the burner nozzle, and a triggering circuit connected to the gate of the semiconductor switching device to trigger automatically and periodically the same by means of the charged voltage of the storage capacitor.

2. An electrically-ignited gas lighter according to claim 1 wherein the blocking oscillator comprises a transistor, a variable resistor and an oscillation transformer having primary, feedback and output windings; the variable resistor being connected between the base electrode of the transistor and the battery through the feedback winding; the primary winding of the oscillation transformer, the collector-emitter path of the transistor and the battery comprising a closed circuit.

3. An electrically-ignited gas lighter according to claim 2 wherein the switch is connected between the battery and the conjunction of the feedback and primary windings of the oscillation transformer.

4. An electrically-ignited gas lighter according to claim 2 wherein the variable resistor has a resistance value of 10 K ohms maximum.

5. An electrically-ignited gas lighter according to claim 1 wherein the triggering circuit comprises a zener diode, a diac and a resistor in series connection and is connected in parallel with the discharge circuit, the resistor being connected between the gate electrode of the semi-conductor switching device and the cathode electrode.

6. An electrically-ignited gas lighter according to claim 1 wherein the triggering circuit comprises at least two diacs and a resistor in series connection and is connected in parallel with the discharge circuit, the resistor being connected between the gate electrode of the semi-conductor switching device and the cathode electrode.

7. An electrically-ignited gas lighter according to claim 1 wherein the triggering circuit comprises a zener diode, three diacs and a resistor in series connection and is connected in parallel with the discharge circuit, the resistor being connected between the gate electrode of the semi-conductor switching device and the cathode electrode.

8. An electrically-ignited gas lighter according to claim 1 wherein the triggering circuit comprises a silicon bilateral switch, a zener diode and a resistor in series connection and is connected in parallel with the discharge circuit, the resistor being connected between the gate electrode of the semi-conductor switching device and the cathode electrode.

9. An electrically-ignited gas lighter according to claim 1 wherein the semi-conductor switching device is a silicon controlled rectifier.

10. An electrically-ignited gas lighter according to claim 9 wherein the resistor connected between the gate and cathode electrodes of the silicon controlled rectifier has a resistance value of 100 ohms ± 30%.

11. An electrically-ignited gas lighter according to claim 9 wherein the trigger of the silicon controlled rectifier is at least 100 volts.

12. An electrically-ignited gas lighter according to claim 1 wherein the charged voltage of the storage capacitor is at least 100 volts.

13. An electrically-ignited gas lighter according to claim 12 wherein the capacity of the storage capacitor is 1.5 to 2.5 microfarads.

14. An electrically-ignited gas lighter according to claim 12 wherein the turns ratio of the step-up transformer is at least 1:60.

15. An electrically-ignited gas lighter according to claim 1 wherein the battery is a silver oxice battery having 1.5 volts.

16. An electrically-ignited gas lighter according to claim 1 wherein the transistor of the blocking oscillator, the half-wave rectifier, the triggering circuit and the missing text circuit unit.

17. An electrically-ignited gas lighter according to claim 16 wherein the integrated circuit unit has five terminal legs.

18. An electrically-ignited gas lighter according to claim 1 wherein the step-up transformer is disposed in the upper portion of the circuit case and a circuit plate on which the other electric parts are soldered is disposed in the lower portion of the circuit case.

19. An electrically-ignited gas lighter according to claim 18 wherein the circuit plate has a printed circuit thereon.

20. An electrically-ignited gas lighter according to claim 18 wherein the other electric parts comprise an oscillation transformer disposed in the lowest portion of the circuit case.

21. An electrically-ignited gas lighter according to claim 20 wherein the oscillation transformer is fixed to the circuit plate by a fixing screw to prevent relaxation oscillation noise of the oscillation transformer.

22. An electrically-ignited gas lighter according to claim 21 wherein the fixing screw engages a nut portion of the circuit case to fix the circuit plate.

23. An electrically-ignited gas lighter according to claim 1 wherein the circuit case is filled with a silicon resin to fix the electric parts in the circuit case and to provide electric insulation.

24. An electrically-ignited gas lighter according to claim 18 wherein the circuit plate has first and second plates between which the electric parts are sandwiched.

25. An electrically-ignited gas lighter according to claim 1 wherein the circuit case has at its lower portion a terminal plate for connecting a pole of the battery and the other pole of the battery is grounded to the casing.

26. An electrically-ignited gas lighter according to claim 25 wherein a spring is disposed between the other pole of the battery and the casing to urge the battery towards the terminal plate.

27. An electrically-ignited gas lighter according to claim 1 wherein the burner nozzle is electrically insulated from the fuel tank through an insulator tube and is connected to the high voltage terminal of the secondary winding of the step-up transformer.

28. An electrically-ignited gas lighter according to claim 1 wherein the circuit case is integrally formed with a switch guide at its upper portion for conduction to a switch actuator.

* * * * *

UNITED STATES PATENT AND TRADEMARK OFFICE

CERTIFICATE OF CORRECTION

PATENT NO. : 4,023,922

DATED : May 17, 1977

INVENTOR(S) : Kenjiro Goto

It is certified that error appears in the above-identified patent and that said Letters Patent are hereby corrected as shown below:

Column 1, line 41, delete "andstable" and insert --and stable--.

Column 6, line 47, delete "support 116 us" and insert --support 116 is--.

Column 7, line 64, after "burner" insert --nozzle--.

Column 8, line 34, after "a silicon" insert --resin--.

Column 9, line 22, after "the circuit" insert --case--.

Claim 11, line 45 after "trigger" insert -- voltage --.

Claim 16, line 62, delete "the missing text circuit unit" and insert --the semi-conductor switching device are part of an integrated circuit unit--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*